US011238776B2

(12) United States Patent
Yang et al.

(10) Patent No.: US 11,238,776 B2
(45) Date of Patent: Feb. 1, 2022

(54) PIXEL CIRCUIT AND DRIVING METHOD THEREOF, DISPLAY DEVICE AND DRIVING METHOD THEREOF

(71) Applicant: BOE TECHNOLOGY GROUP CO., LTD., Beijing (CN)

(72) Inventors: Fei Yang, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/765,932

(22) PCT Filed: Apr. 30, 2019

(86) PCT No.: PCT/CN2019/085306
§ 371 (c)(1),
(2) Date: May 21, 2020

(87) PCT Pub. No.: WO2020/220308
PCT Pub. Date: Nov. 5, 2020

(65) Prior Publication Data
US 2021/0233458 A1 Jul. 29, 2021

(51) Int. Cl.
*G09G 3/20* (2006.01)
*G09G 3/3225* (2016.01)

(52) U.S. Cl.
CPC ..... *G09G 3/2092* (2013.01); *G09G 3/3225* (2013.01); *G09G 2300/0426* (2013.01);
(Continued)

(58) Field of Classification Search
CPC . G09G 3/325–3266; G09G 2300/0426; G09G 2300/0739; G09G 2300/0819;
(Continued)

(56) References Cited

U.S. PATENT DOCUMENTS 9,035,976 B2 5/2015 Lee et al.
9,087,483 B2 7/2015 Kim et al.
(Continued)

FOREIGN PATENT DOCUMENTS

CN 102968954 A 3/2013
CN 103366676 A 10/2013
(Continued)

OTHER PUBLICATIONS

Chinese Office Action in Chinese Application No. 201980000628.2, dated Mar. 3, 2021 with English translation.
(Continued)

*Primary Examiner* — Nathan Danielsen
(74) *Attorney, Agent, or Firm* — Collard & Roe, P.C.

(57) ABSTRACT

A pixel circuit and a driving method thereof, and a display device and a driving method thereof are disclosed. The pixel circuit includes a drive circuit, a reset circuit, and a sensing circuit. A control terminal of the drive circuit is configured to receive a data voltage, a first terminal of the drive circuit is configured to receive a first voltage, and a second terminal of the drive circuit is configured to be electrically connected to a light-emitting element. The reset circuit is electrically connected to the second terminal of the drive circuit, and is configured to reset the second terminal of the drive circuit in response to a first scanning signal. The sensing circuit is electrically connected to the second terminal of the drive circuit, and is configured to connect the second terminal of the drive circuit to a sensing signal line in response to a second scanning signal.

15 Claims, 4 Drawing Sheets

(52) U.S. Cl.
CPC ..... *G09G 2310/027* (2013.01); *G09G 2310/0278* (2013.01); *G09G 2310/061* (2013.01)

(58) Field of Classification Search
CPC ..... G09G 2300/0842–0852; G09G 2310/027; G09G 2310/0278; G09G 2310/061; G09G 2310/08; G09G 2320/0204; G09G 2320/0233; G09G 2320/0242; G09G 2320/0252; G09G 2320/029; G09G 2320/0295; G09G 2320/045; G09G 2320/0633
See application file for complete search history.

(56) References Cited

U.S. PATENT DOCUMENTS

| | | | | |
|---|---|---|---|---|
| 9,111,488 | B2 | 8/2015 | Kwak | |
| 9,647,047 | B2 | 5/2017 | Jeong et al. | |
| 9,741,288 | B2 | 8/2017 | Zhang | |
| 9,905,164 | B2 | 2/2018 | Mizukoshi | |
| 10,032,414 | B2 | 7/2018 | Kim et al. | |
| 10,354,590 | B2 | 7/2019 | Nie et al. | |
| 2009/0225011 | A1 | 9/2009 | Choi | |
| 2013/0021312 | A1* | 1/2013 | Kishi | G09G 3/3225 345/211 |
| 2013/0257831 | A1* | 10/2013 | Kim | G09G 3/3233 345/205 |
| 2015/0130785 | A1* | 5/2015 | Shin | G09G 5/18 345/213 |
| 2017/0061876 | A1* | 3/2017 | Cho | G09G 3/3233 |
| 2019/0172394 | A1 | 6/2019 | Wang et al. | |

FOREIGN PATENT DOCUMENTS

| | | | |
|---|---|---|---|
| CN | 103578411 | A | 2/2014 |
| CN | 103839513 | A | 6/2014 |
| CN | 104167177 | A | 11/2014 |
| CN | 104183215 | A | 12/2014 |
| CN | 105741760 | A | 7/2016 |
| CN | 106328061 | A | 1/2017 |
| CN | 107731171 | A | 2/2018 |
| CN | 107749280 | A | 3/2018 |

OTHER PUBLICATIONS

International Search Report of PCT/CN2019/085306 in Chinese, dated Jan. 23, 2020, with English translation.
Notice of Transmittal of the International Search Report of PCT/CN2019/085306 in Chinese, dated Jan. 23, 2020.
Written Opinion of the International Searching Authority of PCT/CN2019/085306 in Chinese, dated Jan. 23, 2020.

* cited by examiner

PIXEL CIRCUIT AND DRIVING METHOD THEREOF, DISPLAY DEVICE AND DRIVING METHOD THEREOF

CROSS REFERENCE TO RELATED APPLICATIONS

This application is the National Stage of PCT/CN2019/085306 filed on Apr. 30, 2019, the disclosure of which is incorporated by reference.

TECHNICAL FIELD

Embodiments of the present disclosure relate to a pixel circuit and a driving method thereof, and a display device and a driving method thereof.

BACKGROUND

Compared with traditional liquid crystal display panels, organic light-emitting diode (OLED) display panels have advantages of the faster response, higher contrast, wider viewing angle, lower power consumption and the like, and have been increasingly used for high performance display.

The pixel circuit in the OLED display panel generally adopts a matrix driving method, and the driving method of the pixel circuit includes active matrix (AM) driving and passive matrix (PM) driving depending on whether the switching element is provided in each pixel unit. Although the PMOLED has advantages of the simple process and low cost, but cannot satisfy requirements of high-resolution and large-size display because of shortcomings of the crosstalk, high power consumption, short lifetime, etc. In contrast, the AMOLED integrates a group of the thin film transistor and storage capacitor in the pixel circuit of each pixel unit, and by driving and controlling the group of the thin film transistor and storage capacitor, the current flowing through the OLED can be controlled, so that the OLED can emit light as needed. Compared with the PMOLED, the driving current required for the AMOLED is smaller, the power consumption of the AMOLED is lower, and the lifetime of the AMOLED is longer, so that the AMOLED can satisfy the large-size display requirements of high resolution and multi-grayscale. Moreover, the AMOLED has obvious advantages in the viewing angle, color reproduction, power consumption, response time and the like, and is suitable for display devices with high information content and high resolution.

SUMMARY

At least an embodiment of the present disclosure provides a pixel circuit, and the pixel circuit includes a drive circuit, a reset circuit, and a sensing circuit; the drive circuit includes a control terminal, a first terminal, and a second terminal, the control terminal of the drive circuit is configured to receive a data voltage, the first terminal of the drive circuit is configured to receive a first voltage, and the second terminal of the drive circuit is configured to be electrically connected to a light-emitting element; the reset circuit is electrically connected to the second terminal of the drive circuit, and is configured to reset the second terminal of the drive circuit in response to a first scanning signal; and the sensing circuit is electrically connected to the second terminal of the drive circuit, and is configured to connect the second terminal of the drive circuit to a sensing signal line in response to a second scanning signal, the second scanning signal being different from the first scanning signal.

For example, the pixel circuit provided by at least an embodiment of the present disclosure further includes a data writing circuit and a storage circuit, the data writing circuit is electrically connected to the control terminal of the drive circuit, and is configured to apply the data voltage to the control terminal of the drive circuit in response to the first scanning signal, a first terminal of the storage circuit is electrically connected to the control terminal of the drive circuit, and a second terminal of the storage circuit is electrically connected to the second terminal of the drive circuit.

For example, the pixel circuit provided by at least an embodiment of the present disclosure further includes the light-emitting element, the light-emitting element includes a first terminal and a second terminal, the first terminal of the light-emitting element is electrically connected to the second terminal of the drive circuit, and the second terminal of the light-emitting element is configured to receive a second voltage, the second voltage being lower than the first voltage.

For example, in the pixel circuit provided by at least an embodiment of the present disclosure, the drive circuit includes a first transistor, a gate electrode of the first transistor serves as the control terminal of the drive circuit, a first electrode of the first transistor serves as the first terminal of the drive circuit, and a second electrode of the first transistor serves as the second terminal of the drive circuit.

For example, in the pixel circuit provided by at least an embodiment of the present disclosure, the reset circuit includes a second transistor, a gate electrode of the second transistor is electrically connected to a first scanning line to receive the first scanning signal, a first electrode of the second transistor is electrically connected to the second terminal of the drive circuit, and a second electrode of the second transistor is electrically connected to a reset voltage terminal to receive a reset voltage.

For example, in the pixel circuit provided by at least an embodiment of the present disclosure, the sensing circuit includes a third transistor, a gate electrode of the third transistor is electrically connected to a second scanning line to receive the second scanning signal, a first electrode of the third transistor is electrically connected to the second terminal of the drive circuit, and a second electrode of the third transistor is electrically connected to the sensing signal line.

For example, in the pixel circuit provided by at least an embodiment of the present disclosure, the data writing circuit includes a fourth transistor, the storage circuit includes a storage capacitor, a gate electrode of the fourth transistor is electrically connected a first scanning line to receive the first scanning signal, a first electrode of the fourth transistor is electrically connected to a data line to receive the data voltage, a second electrode of the fourth transistor is electrically connected to the control terminal of the drive circuit, a first electrode of the storage capacitor serves as the first terminal of the storage circuit, and a second electrode of the storage capacitor serves as the second terminal of the storage circuit.

At least an embodiment of the present disclosure further provides a driving method of the pixel circuit according to any one of the embodiments of the present disclosure, and the driving method includes: writing a reference data voltage to the control terminal of the drive circuit and controlling the reset circuit to be turned on in a reset phase, so as to reset the second terminal of the drive circuit through the reset circuit; controlling the reset circuit to be turned off, controlling the sensing circuit to be turned on, applying a current generated by the drive circuit to the sensing signal line under control of the reference data voltage, and obtaining a sensing signal on the sensing signal line in a charging phase; obtaining a compensated display data voltage according to the sensing signal in a compensation calculating phase; and writing the compensated display data voltage to the control terminal of the drive circuit in a data writing phase.

For example, in the driving method of the pixel circuit provided by at least an embodiment of the present disclosure, obtaining the compensated display data voltage according to the sensing signal includes: calculating a characteristic parameter of the drive circuit according to the sensing signal, and compensating for a display data voltage applied to the drive circuit based on the characteristic parameter to obtain the compensated display data voltage.

For example, the driving method of the pixel circuit provided by at least an embodiment of the present disclosure further includes: driving the light-emitting element to emit light through the drive circuit under control of the compensated display data voltage in a display phase.

For example, the driving method of the pixel circuit provided by at least an embodiment of the present disclosure further includes: controlling the reset circuit to be turned on to reset the second terminal of the drive circuit through the reset circuit in the data writing phase.

For example, in the driving method of the pixel circuit provided by at least an embodiment of the present disclosure, in a case where the pixel circuit includes a data writing circuit, the driving method further includes: controlling the data writing circuit to be turned on to write the reference data voltage to the control terminal of the drive circuit to initialize the drive circuit in the reset phase, and controlling the data writing circuit to be turned on to write the compensated display data voltage to the control terminal of the drive circuit in the data writing phase.

At least an embodiment of the present disclosure further provides a display device including a plurality of sub-pixels, and each of the sub-pixels includes the pixel circuit according to any one of the embodiments of the present disclosure.

For example, the display device provided by at least an embodiment of the present disclosure further includes a data driver, the data driver includes a compensation value calculating circuit and a compensation calculating circuit, the compensation value calculating circuit is configured to calculate a characteristic parameter of the drive circuit of the sub-pixel according to acquired compensation detecting data of the sub-pixel, and the compensation calculating circuit is configured to calculate compensated display data, which is to be applied to the sub-pixel, based on display data provided to the sub-pixel and the characteristic parameter calculated by the compensation value calculating circuit.

For example, in the display device provided by at least an embodiment of the present disclosure, the data driver further includes a detection control circuit and an output control circuit, the detection control circuit includes a detection circuit, the detection circuit is configured to acquire a sensing signal on a sensing signal line electrically connected to the drive circuit of the sub-pixel, the detection control circuit is further configured to convert the sensing signal into sensing data, the compensation detecting data includes the sensing data, the output control circuit is configured to convert the compensated display data into a display data voltage, the output control circuit includes an output circuit, and the output circuit is configured to apply the display data voltage to the drive circuit of the sub-pixel, so as to allow the drive circuit of the sub-pixel to drive the light-emitting element of the sub-pixel to emit light under control of the display data voltage.

At least an embodiment of the present disclosure further provides a driving method of the display device according to any one of the embodiments of the present disclosure, the plurality of sub-pixels are arranged in an array, and the driving method includes: writing a corresponding display data voltage to a sub-pixel in an (n−1)-th row, and simultaneously acquiring a sensing signal corresponding to a sub-pixel in an n-th row, where n is an integer greater than 1.

For example, in the driving method of the display device provided by at least an embodiment of the present disclosure, in a period of one frame of display image, the driving method specifically includes: writing a corresponding reference data voltage to a control terminal of a drive circuit of the sub-pixel in the n-th row, and resetting a second terminal of the drive circuit of the sub-pixel in the n-th row; writing the corresponding display data voltage to a control terminal of a drive circuit of the sub-pixel in the (n−1)-th row, resetting a second terminal of the drive circuit of the sub-pixel in the (n−1)-th row, and simultaneously acquiring a first sensing signal corresponding to the sub-pixel in the n-th row; acquiring a corresponding display data voltage of the sub-pixel in the n-th row according to the first sensing signal, simultaneously writing a corresponding reference data voltage to a control terminal of a drive circuit of a sub-pixel in an (n+1)-th row, and resetting a second terminal of the drive circuit of the sub-pixel in the (n+1)-th row; and writing the corresponding display data voltage to the control terminal of the drive circuit of the sub-pixel in the n-th row, resetting the second terminal of the drive circuit of the sub-pixel in the n-th row, and simultaneously acquiring a second sensing signal corresponding to the sub-pixel in the (n+1)-th row.

For example, in the driving method of the display device provided by at least an embodiment of the present disclosure, a plurality of pixel circuits in one column are connected to an identical data line and an identical sensing signal line, and in a period of one frame of display image, the driving method includes: in one column, writing a corresponding reference data voltage to a control terminal of a drive circuit of the sub-pixel in the n-th row through a data line, and resetting a second terminal of the drive circuit of the sub-pixel in the n-th row and a sensing signal line; in the one column, writing a corresponding display data voltage to a control terminal of a drive circuit of the sub-pixel in the (n−1)-th row through the data line, resetting a second terminal of the drive circuit of the sub-pixel in the (n−1)-th row, and allowing the second terminal of the drive circuit of the sub-pixel in the n-th row to be connected to the sensing signal line to apply a current generated by the drive circuit of the sub-pixel in the n-th row to the sensing signal line under control of the corresponding reference data voltage; in the one column, writing a corresponding reference data voltage to a control terminal of a drive circuit of a sub-pixel in an (n+1)-th row through the data line, and resetting a second terminal of the drive circuit of the sub-pixel in the (n+1)-th row and the sensing signal line; and in the one column, writing the corresponding display data voltage to the control terminal of the drive circuit of the sub-pixel in the n-th row through the data line, resetting the second terminal of the drive circuit of the sub-pixel in the n-th row, and allowing the second terminal of the drive circuit of the sub-pixel in the (n+1)-th row to be connected to the sensing signal line to apply a current generated by the drive circuit of the sub-pixel in the (n+1)-th row to the sensing signal line under control of the corresponding reference data voltage.

BRIEF DESCRIPTION OF THE DRAWINGS

In order to clearly illustrate the technical solutions of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1:
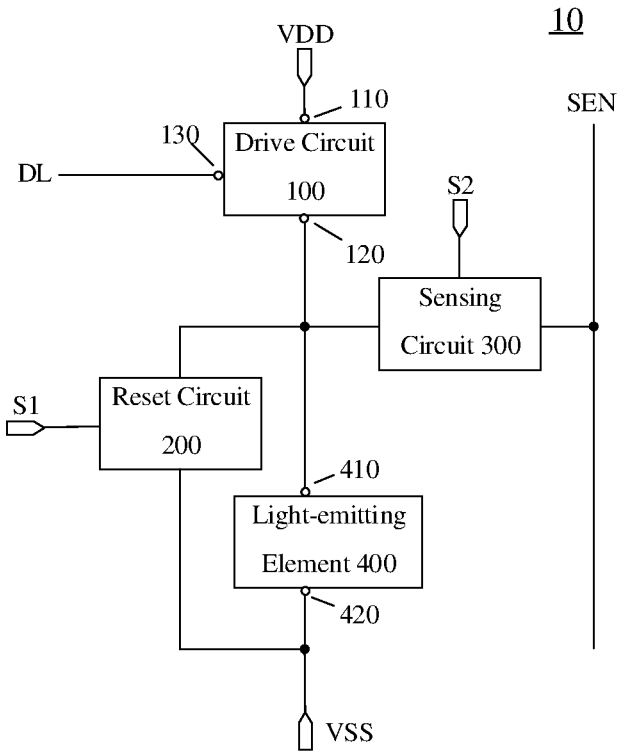
FIG. 1 is a schematic block diagram of a pixel circuit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

A basic pixel circuit used in an AMOLED display device is usually a 2T1C pixel circuit, that is, two thin film transistors (TFT) and a storage capacitor are used to implement a basic function of driving an OLED to emit light. Because of the influence of factors such as long-time conduction and temperature changes, the threshold voltage of the drive transistor in each of pixel circuits may be different and cause drift phenomena, thereby resulting in uneven brightness of the display image. Therefore, in order to achieve the good display effect, it is necessary to detect and compensate for the threshold voltage of each drive transistor.

A compensation method for the pixel circuit includes two types of external compensation and internal compensation. Compared with the internal compensation method, the external compensation method usually detects and compensates for a row of pixel circuits in the display device during a blanking phase of one frame of display image, that is, only one row of pixel circuits can be detected and compensated in one frame, so that the compensation speed of the external compensation is much lower than the compensation speed of the internal compensation. For example, taking a display device with a resolution of 3480*1260 as an example, in the case where a frame rate is 60 Hz, the time period required for detecting and compensating for all pixel circuits in the display device by using the external compensation method is 2160/60*3=108 seconds (s), and the time period required for the internal compensation method is 16.6 milliseconds (ms), which is only about 1/6480 of the time period required for the external compensation method. Therefore, in the case where the external compensation method is used to detect and compensate for the threshold voltage of the drive transistor, because of the long time period required, the compensation effect of the display image is limited, so that the display device cannot achieve a good real-time compensation effect, thereby affecting the display quality of the image and reducing the user experience.

In addition, because the external compensation method usually needs to process a huge amount of compensation data, the complexity of the compensation circuit is increased, so that the compensation circuit cannot achieve a good compatibility effect with the display device, resulting in that the integrated performance of the processor and the memory chip in the display device may be reduced. Moreover, the display device using the external compensation method needs to be provided with the processor and the memory chip with superior performance, which may further increase the manufacturing cost of the display device.

At least one embodiment of the present disclosure provides a pixel circuit and a driving method thereof. The pixel circuit may simplify the driving method based on the pixel circuit and reduce the time required for detecting and compensating for the characteristic parameters of the drive circuit in the pixel circuit, thereby achieving the compensation effect of real-time compensation and allowing the display device including the pixel circuit to obtain a display image with better quality.

At least one embodiment of the present disclosure further provides a display device and a driving method thereof. The display device includes the above pixel circuit and a data driver. Through the above pixel circuit, the data driver of the display device may integrate the detection function and the calculation function for the compensation data into the corresponding processor and memory chip inside the data driver, thereby reducing the performance requirements of the processor and memory chip. In some embodiments, the circuit design around the timing controller (T-con) in the display device may be further simplified, so that the integration of the display device is significantly improved, and the manufacturing cost of the display device is effectively reduced.

Hereinafter, some embodiments of the present disclosure are described in detail with reference to the accompanying drawings. It should be noted that the same reference numerals used in different drawings refer to the same described components.

At least one embodiment of the present disclosure provides a pixel circuit, and the pixel circuit includes a drive circuit, a reset circuit, and a sensing circuit. The drive circuit includes a control terminal, a first terminal, and a second terminal, the control terminal of the drive circuit is configured to receive a data voltage, the first terminal of the drive circuit is configured to receive a first voltage, and the second terminal of the drive circuit is configured to be electrically connected to a light-emitting element. The reset circuit is electrically connected to the second terminal of the drive circuit, and is configured to reset the second terminal of the drive circuit in response to a first scanning signal. The sensing circuit is electrically connected to the second terminal of the drive circuit, and is configured to connect the second terminal of the drive circuit to a sensing signal line in response to a second scanning signal, the second scanning signal being different from the first scanning signal.

FIG. 1 is a schematic block diagram of a pixel circuit 10 provided by some embodiments of the present disclosure. As illustrated in FIG. 1, the pixel circuit 10 includes a drive circuit 100, a reset circuit 200, and a sensing circuit 300.

The drive circuit 100 includes a first terminal 110, a second terminal 120, and a control terminal 130. The control terminal 130 of the drive circuit 100 is configured to be electrically connected to a data line DL to receive a data voltage, and for example, the data voltage includes a display data voltage Vdat for a display operation and a reference data voltage Vref for a detection operation. The first terminal 110 of the drive circuit 100 is configured to be electrically connected to a first voltage terminal VDD to receive a first voltage provided by the first voltage terminal VDD, and for example, the first voltage may be a high level voltage. The second terminal 120 of the drive circuit 100 is configured to be electrically connected to a light-emitting element 400 to apply a driving current generated by the drive circuit 100 to the light-emitting element 400 during a display phase, so as to drive the light-emitting element 400 to emit light.

The light-emitting element 400 includes a first terminal 410 and a second terminal 420, the first terminal 410 of the light-emitting element 400 is configured to be electrically connected to the second terminal 120 of the drive circuit 100, and the second terminal 420 of the light-emitting element 400 is configured to be electrically connected to a second voltage terminal VSS to receive a second voltage. The second voltage is, for example, a low level voltage or a ground voltage, which is lower than the first voltage.

For example, in the display phase, after the drive circuit 100 receives the first voltage provided by the first voltage terminal VDD, the drive circuit 100 generates a corresponding driving current under control of the display data voltage Vdat provided by the data line DL, and applies the driving current to the first terminal 410 of the light-emitting element 400 to drive the light-emitting element 400 to emit light according to a required "grayscale". For example, the light-emitting element 400 may use an organic light-emitting diode (OLED) or a quantum dot light-emitting diode (QLED), and the embodiments of the present disclosure include but are not limited to this case.

The reset circuit 200 is electrically connected to the second terminal 120 of the drive circuit 100, a reset voltage terminal, and a first scanning line SL1, respectively, and is configured to be turned on in response to a first scanning signal S1 provided by the first scanning line SL1, and reset the second terminal 120 of the drive circuit 100 by, for example, a reset voltage provided by the reset voltage terminal. For example, the reset voltage may be a low level voltage (for example, a voltage lower than 0V) or a ground voltage. The reset voltage may be provided by a reset voltage terminal (for example, a third voltage terminal) additionally provided, or may be provided by the second voltage terminal VSS as illustrated in FIG. 1 in the case where the voltage provided by the second voltage terminal VSS is a low level voltage or a ground voltage. The embodiments of the present disclosure are described by taking the case that the reset voltage is provided by the second voltage terminal VSS as an example, but this is not limitative of the embodiments of the present disclosure.

For example, as illustrated in FIG. 1, the reset circuit 200 is electrically connected to the second terminal 120 of the drive circuit 100, the second voltage terminal VSS (i.e., the reset voltage terminal), and the first scanning line SL1, respectively, and is configured to electrically connect the second terminal 120 of the drive circuit 100 to the second voltage terminal VSS in response to the first scanning signal S1 provided by the first scanning line SL1, and apply the second voltage provided by the second voltage terminal VSS to the second terminal 120 of the drive circuit 100 to initialize the second terminal 120 of the drive circuit 100.

For example, as illustrated in FIG. 1, the reset circuit 200 may also be electrically connected to the first terminal 410 of the light-emitting element 400, and may be configured to electrically connect the first terminal 410 of the light-emitting element 400 to the second voltage terminal VSS in response to the first scanning signal S1 provided by the first scanning line SL1, and apply the second voltage provided by the second voltage terminal VSS to the first terminal 410 of the light-emitting element 400 to initialize the first terminal 410 of the light-emitting element 400.

The sensing circuit 300 is electrically connected to the second terminal 120 of the drive circuit 100, the sensing signal line SEN, and the second scanning line SL2, respectively, and is configured to connect the second terminal 120 of the drive circuit 100 to the sensing signal line SEN in response to the second scanning signal S2 (different from the first scanning signal S1) provided by the second scanning line SL2, so as to apply the current (that is, the charging current) generated by the drive circuit 110 to the sensing signal line SEN to charge the sensing signal line SEN in the case where the reference data voltage Vref is written to the control terminal 130 of the drive circuit 100. For example, after the sensing signal line SEN being charged for a certain period of time, the characteristic parameter of the drive circuit 100 may be calculated according to the sensing signal (specifically a voltage signal, such as a sensing voltage) detected on the sensing signal line SEN.

It should be noted that charging the sensing signal line SEN may be charging a capacitor electrically connected to the sensing signal line SEN, and the voltage stored in the capacitor may be detected as a sensing signal after the capacitor being charged for a certain period of time. Alternatively, charging the sensing signal line SEN may also be charging a parasitic capacitor on the sensing signal line SEN, and the embodiments of the present disclosure are not limited thereto.

For example, as illustrated in FIG. 1, the sensing circuit 300 may also be electrically connected to the reset circuit 200, and in the case where the reset circuit 200 is turned on in response to the first scanning signal S1 and the sensing circuit 300 is turned on in response to the second scanning signal S2, the sensing circuit 300 electrically connects the sensing signal line SEN to the second voltage terminal VSS, thereby initializing the sensing signal line SEN by the second voltage provided by the second voltage terminal VSS. For example, in some other embodiments, the sensing signal line SEN may also be electrically connected to a low level voltage terminal or a ground voltage terminal (such as a fourth voltage terminal) additionally provided to initialize the sensing signal line SEN, and the embodiments of the present disclosure are not limited in this aspect.

Figure 2:
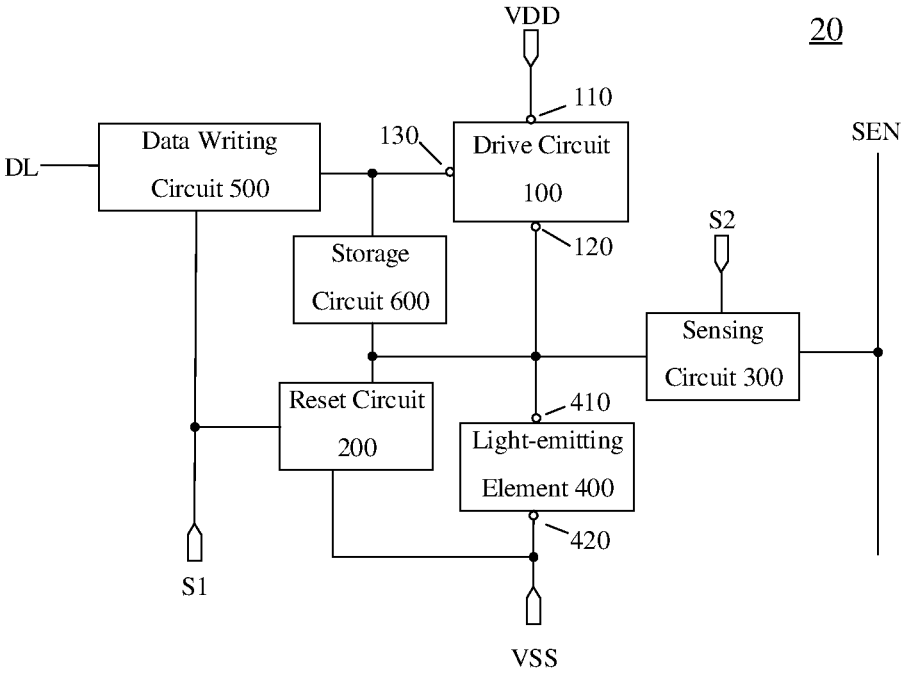
FIG. 2 is a schematic block diagram of another pixel circuit provided by some embodiments of the present disclosure.

FIG. 2 is a schematic block diagram of another pixel circuit 20 provided by some embodiments of the present disclosure. As illustrated in FIG. 2, the pixel circuit 20 further includes a data writing circuit 500 and a storage circuit 600. The other structures of the pixel circuit 20 are basically the same as those of the pixel circuit 10 illustrated in FIG. 1.

The data writing circuit 500 is electrically connected to the control terminal 130 of the drive circuit 100, the first scanning line SL1, and the data line DL, respectively, and is configured to apply the data voltage (for example, the display data voltage Vdat and the reference data voltage Vref) provided by the data line DL to the control terminal 130 of the drive circuit 100 in response to the first scanning signal S1 provided by the first scanning line SL1.

The first terminal of the storage circuit 600 is electrically connected to the control terminal 130 of the drive circuit 100, and the second terminal of the storage circuit 600 is electrically connected to the second terminal 120 of the drive circuit 100. For example, the storage circuit 600 is configured to store the data voltage (for example, the display data voltage Vdat and the reference data voltage Vref) written through the data writing circuit 500.

By taking the structure of the pixel circuit 20 illustrated in FIG. 2 as an example, an exemplary specific implementation of the pixel circuit 20 and a driving method based on the pixel circuit 20 are described below.

Figure 3:
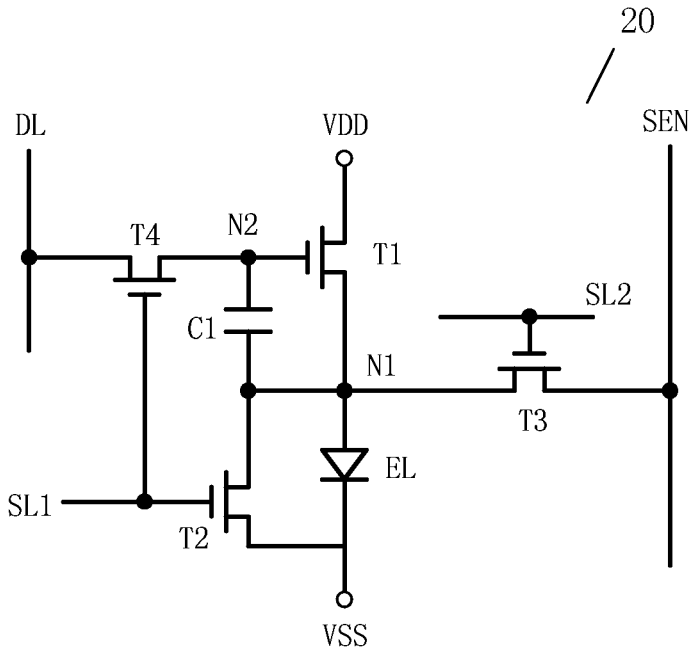
FIG. 3 is a circuit diagram of a specific example of the pixel circuit illustrated in FIG. 2.

FIG. 3 is a circuit diagram of a specific example of the pixel circuit 20 illustrated in FIG. 2. As illustrated in FIG. 3, the pixel circuit 20 includes first to fourth transistors T1, T2, T3, and T4, and includes a storage capacitor C1 and a light-emitting element EL. For example, the first transistor T1 is used as a drive transistor, and the second to fourth transistors T2, T3, and T4 are used as switching transistors.

For example, the first to fourth transistors T1, T2, T3, and T4 may all use N-type transistors or P-type transistors, or a part of the first to fourth transistors T1, T2, T3, and T4 may use N-type transistors and the other part of the first to fourth transistors T1, T2, T3, and T4 may use P-type transistors. The following description is described by taking the case that each transistor is an N-type transistor as an example, but this is not limitative of the embodiments of the present disclosure.

For example, the drive circuit 100 may be implemented as the first transistor T1. A gate electrode of the first transistor T1 serves as the control terminal 130 of the drive circuit 100 and is electrically connected to the second node N2, a first electrode of the first transistor T1 serves as the first terminal 110 of the drive circuit 100, and a second electrode of the first transistor T1 serves as the second terminal 120 of the drive circuit 100 and is electrically connected to the first node N1.

For example, the reset circuit 200 may be implemented as the second transistor T2. A gate electrode of the second transistor T2 is electrically connected to the first scanning line SL1 to receive the first scanning signal S1, a first electrode of the second transistor T2 is electrically connected to the first node N1 (i.e., the second electrode of the first transistor T1), and a second electrode of the second transistor T2 is electrically connected to the second voltage terminal VSS (i.e., the reset voltage terminal) to receive the second voltage (i.e., the reset voltage). The second transistor T2 is turned on in response to a high level of the first scanning signal S1 and turned off in response to a low level of the first scanning signal S1.

For example, the sensing circuit 300 may be implemented as the third transistor T3. A gate electrode of the third transistor T3 is electrically connected to the second scanning line SL2 to receive the second scanning signal S2, a first electrode of the third transistor T3 is electrically connected to the first node N1 (i.e., the second electrode of the first transistor T1), and a second electrode of the third transistor T3 is electrically connected to the sensing signal line SEN. The third transistor T3 is turned on in response to a high level of the second scanning signal S2 and turned off in response to a low level of the second scanning signal S2.

For example, the data writing circuit 500 may be implemented as the fourth transistor T4. A gate electrode of the fourth transistor T4 is electrically connected to the first scanning line SL1 to receive the first scanning signal S1, a first electrode of the fourth transistor T4 is electrically connected to the data line DL to receive the data voltage, and a second electrode of the fourth transistor T4 is electrically connected to the second node N2 (i.e., the gate electrode of the first transistor T1). The fourth transistor T4 is turned on in response to a high level of the first scanning signal S1 and turned off in response to a low level of the first scanning signal S1.

For example, the storage circuit 600 may be implemented as the storage capacitor C1. A first electrode of the storage capacitor C1 serves as the first terminal of the storage circuit 600 and is electrically connected to the second node N2 (i.e., the gate electrode of the first transistor T1), and a second electrode of the storage capacitor C1 serves as the second terminal of the storage circuit 600 and is electrically connected to the first node N1 (i.e., the second electrode of the first transistor T1).

For example, the light-emitting element 400 may be a light-emitting element EL, the anode of the light-emitting element EL serves as the first terminal 410 of the light-emitting element 400 and is electrically connected to the first node N1 (i.e., the second electrode of the first transistor T1), and the cathode of the light-emitting element EL serves as the second terminal 420 of the light-emitting element 400 and is electrically connected to the second voltage terminal VSS.

For example, the light-emitting element EL may be the OLED or QLED of various types, such as the top emission, bottom emission, double-sided emission, etc., and may emit red light, green light, blue light, white light, or the like, and the embodiments of the present disclosure are not limited thereto.

It should be noted that the transistors used in the embodiments of the present disclosure may all be thin film transistors, field effect transistors, or other switching components with identical characteristics, and the embodiments of the present disclosure are described by taking the thin film transistors as an example. A source electrode and a drain electrode of each transistor used here may be symmetrical in structure, so the source electrode and the drain electrode of the transistor may have no difference in structure. In the embodiments of the present disclosure, in order to distinguish two electrodes of a transistor except a gate electrode, one of the two electrodes is referred to as a first electrode, and the other of the two electrodes is referred to as a second electrode.

The transistors in the pixel circuit 20 illustrated in FIG. 3 are described by taking the first to fourth transistors T1, T2, T3, and T4 as N-type transistors as an example. In this case, the first electrode may be a drain electrode, and the second electrode may be a source electrode. It should be noted that the embodiments of the present disclosure include but are not limited to this case. For example, one or more transistors in the pixel circuit 20 provided by the embodiments of the present disclosure may also use P-type transistors. In this case, the first electrode of the transistor is a source electrode, and the second electrode of the transistor is a drain electrode, as long as respective electrodes of the selected-type transistor are correspondingly connected in accordance with respective electrodes of the corresponding transistor in the embodiments of the present disclosure, and the corresponding voltage terminal provides the corresponding high or low voltage.

In the case where the N-type transistor is used, indium gallium zinc oxide (IGZO) may be used as an active layer of the thin film transistor, which may effectively reduce the size of the transistor and prevent the leakage current compared with using low temperature poly silicon (LTPS) or amorphous silicon (such as hydrogenated amorphous silicon) as the active layer of the thin film transistor.

It should be noted that the drive circuit 100, the reset circuit 200, the sensing circuit 300, the data writing circuit 500, and the storage circuit 600 may also be circuits composed of other components, and the embodiments of the present disclosure are not limit to this case.

The working principle of the pixel circuit 20 illustrated in FIG. 3 is described below with reference to the signal timing diagram illustrated in FIG. 4.

Figure 4:
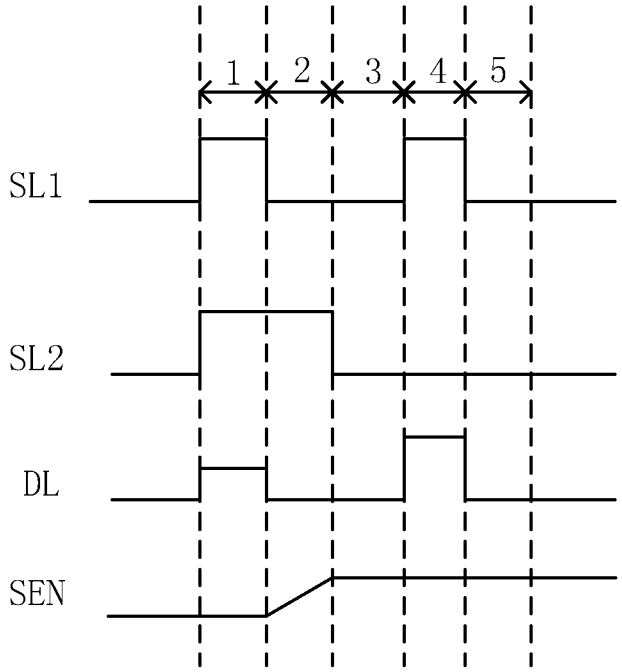
FIG. 4 and FIG. 5 are signal timing diagrams of a pixel circuit provided by some embodiments of the present disclosure.

For example, as illustrated in FIG. 4, displaying a frame of image of the pixel circuit 20 includes five phases, which are a reset phase 1, a charging phase 2, a compensation calculating phase 3, a data writing phase 4, and a display phase 5. FIG. 4 illustrates the timing waveforms on the first scanning line SL1, the second scanning line SL2, the data line DL, and the sensing signal line SEN in each phase.

In the reset phase 1, the first scanning line SL1 provides a high level first scanning signal S1, and the second scanning line SL2 provides a high level second scanning signal S2.

For example, the second transistor T2 is turned on in response to the high level first scanning signal S1, electrically connects the second voltage terminal VSS to the second electrode of the first transistor T1, and applies the second voltage (i.e., the reset voltage) provided by the second voltage terminal VSS to the second electrode of the first transistor T1 to initialize the second electrode of the first transistor T1.

For example, the fourth transistor T4 is turned on in response to the high level first scanning signal S1, writes the reference data voltage Vref provided by the data line DL to the gate electrode of the first transistor T1, and stores the reference data voltage Vref in the storage capacitor C1, so that in the subsequent charging phase 2, the reference data voltage Vref stored in the storage capacitor C1 is used to control the first transistor T1 to generate the corresponding charging current.

For example, the third transistor T3 is turned on in response to the high level second scanning signal S2, and the sensing signal line SEN is electrically connected to the second voltage terminal VSS through the turned-on second transistor T2 and the turned-on third transistor T3. The second voltage provided by the second voltage terminal VSS is applied to the sensing signal line SEN to initialize the sensing signal line SEN. Therefore, in the reset phase 1, the sensing signal (e.g., the sensing voltage) on the sensing signal line SEN is the second voltage (i.e., the reset voltage).

It should be noted that, in some other embodiments, in the reset phase 1, the sensing signal line SEN may also be electrically connected to a low level voltage terminal or a ground voltage terminal (such as a fourth voltage terminal) additionally provided to implement initialization. For example, in the case where the sensing signal line SEN is electrically connected to the additionally provided voltage terminal, for example, the fourth voltage terminal, the sensing signal line SEN does not need to be initialized by the second voltage provided by the second voltage terminal VSS, so that in the reset phase 1, the third transistor T3 may also be in a turn-off state. Therefore, in the case where the fourth voltage terminal is included, in the reset phase 1, the second scanning signal S2 provided by the second scanning line SL2 may be either a high level signal or a low level signal, and the embodiments of the present disclosure are not limited thereto.

In the charging phase 2, the first scanning line SL1 provides a low level first scanning signal S1, and the second scanning line SL2 provides a high level second scanning signal S2. The second transistor T2 and the fourth transistor T4 are turned off in response to the low level first scanning signal S1, and the third transistor T3 is turned on in response to the high level second scanning signal S2.

For example, the first transistor T1 is turned on under control of the reference data voltage Vref stored in the storage capacitor C1 to generate the charging current, and the charging current is applied to the sensing signal line SEN through the third transistor T3 to charge the sensing signal line SEN. Because of the law of conservation of electric charge and the capacitance coupling effect of the storage capacitor C1, the voltage difference between the gate electrode and the second electrode of the first transistor T1 remains unchanged, so that the magnitude of the charging current generated by the first transistor T1 remains unchanged to allow the sensing signal on the sensing signal line SEN to continue to increase linearly. In this case, the internal resistance of the light-emitting element EL is greater than the resistance of the load on the sensing signal line SEN, and therefore, substantially no current flows through the light-emitting element EL. Alternatively, in some embodiments, in the charging phase 2, the second voltage provided by the second voltage terminal VSS may be increased to obtain a third voltage, and the third voltage may reverse bias the light-emitting element EL, so that no current flows through the light-emitting element EL.

For example, after the sensing signal line SEN has been charged for the first time M1, the sensing signal on the sensing signal line SEN may be acquired through a detection circuit (not illustrated in FIG. 3) electrically connected to the sensing signal line SEN, and the sensing signal is used to subsequently calculate or characterize the characteristic parameters (including the threshold voltage and mobility) of the first transistor T1. For example, the duration of the first time M1 may be equal to the duration of the charging phase 2, or may be slightly less than the duration of the charging phase 2, which is not limited in the embodiments of the present disclosure.

For example, in some other embodiments, the sensing signal on the sensing signal line SEN may also be acquired at the initial time of the subsequent compensation calculating phase 3, and the embodiments of the present disclosure are not limited in this aspect.

It should be noted that, after the sensing signal line SEN being charged for the first time M1, the sensing signal (e.g., the sensing voltage) on the sensing signal line SEN may be stored in, for example, a capacitor electrically connected to the sensing signal line SEN, so as to be used in the subsequent compensation calculating phase 3, and the duration of time when the sensing signal is stored in the capacitor is related to, for example, the characteristics of the capacitor, which may not be limited in the embodiments of the present disclosure.

In the compensation calculating phase 3, the first scanning line SL1 provides a low level first scanning signal S1, and the second scanning line SL2 provides a low level second scanning signal S2. The second transistor T2 and the fourth transistor T4 are turned off in response to the low level first scanning signal S1, and the third transistor T3 is turned off in response to the low level second scanning signal S2.

For example, in the compensation calculating phase 3, in the case where a plurality of pixel circuits share one data line DL and one sensing signal line SEN, because the other pixel circuits are in corresponding phases such as the reset phase 1 or the charging phase 2, the data line DL needs to provide corresponding data voltages to the other pixel circuits, so that in the compensation calculating phase 3, the fourth transistor T4 is in a turn-off state, so as to prevent the data voltage on the data line DL from being written to the gate electrode of the first transistor T1 to cause the light-emitting element EL to emit light. Simultaneously, in the compensation calculating phase 3, because the other pixel circuits need to charge the sensing signal line SEN, in order to avoid affecting the sensing signal on the sensing signal line SEN, the third transistor T3 is in a turn-off state.

For example, in some other embodiments, in the case where the respective pixel circuits are electrically connected to different data lines DL and different sensing signal lines SEN, respectively, in the compensation calculating phase 3, the turn-on state or the turn-off state of the second to fourth transistors T2, T3, and T4 may be changed accordingly, and the embodiments of the present disclosure are not limited in this aspect.

For example, in some other embodiments, the second transistor T2 may also be configured to be turned on in response to a third scanning signal provided by a third scanning line. In the compensation calculating phase 3, because the third transistor T3 is in the turn-off state, the turn-on state of the second transistor T2 may not affect the sensing signal on the sensing signal line SEN. Therefore, in the compensation calculating phase 3, in the case where the turn-on state of the second transistor T2 does not affect the working states of other transistors and capacitors in the pixel circuit 20, a high level signal may be applied to the gate electrode of the second transistor T2 to allow the second transistor T2 to be turned on, and the embodiments of the present disclosure are not limited in this aspect.

For example, in the compensation calculating phase 3, the detection circuit provides the acquired sensing signal on the sensing signal line SEN to a corresponding compensation value calculating circuit, and the compensation value calculating circuit calculates the characteristic parameters (for example, the threshold voltage and mobility of the first transistor T1) of the first transistor T1 based on the sensing signal, and provides the calculated characteristic parameters of the first transistor T1 to the compensation calculating circuit. The compensation calculating circuit compensates for the display data voltage Vdat applied to the gate electrode of the first transistor T1 based on the obtained characteristic parameters of the first transistor T1, and the compensated display data voltage Vdat is written to the gate electrode of the first transistor T1 through the fourth transistor T4 and the data line DL in the data writing phase 4 to be described in the following, so that the pixel circuit 20 may achieve the compensation effect of real-time compensation, thereby significantly improving the brightness uniformity of the display image and improving the display quality of the image.

It should be noted that in the process of calculating the characteristic parameter of the first transistor T1 based on the acquired sensing signal and compensating for the display data voltage Vdat based on the characteristic parameter, the corresponding compensation calculating method may not be limited in the embodiments of the present disclosure. For example, the above compensation value calculating circuit may calculate to obtain the threshold voltage of the first transistor T1 only based on the sensing signal acquired in one compensation calculating phase 3, and the compensation calculating circuit may compensate for the display data voltage Vdat according to the threshold voltage. For example, the magnitude of the written reference data voltage Vref may also be adjusted in two reset phases 1 of displaying two frames of images, so as to obtain different sensing signals, such as a first sensing voltage Vsen1 and a second sensing voltage Vsen2, subsequent to the sensing signal line SEN being charged, and compensate for the display data voltage Vdat based on the acquired first sensing voltage Vsen1 and second sensing voltage Vsen2.

In the following, a method for calculating the threshold voltage Vth of the first transistor T1 and the process constant K of the first transistor T1 is described by taking the case that two sensing voltages are respectively acquired in the process of displaying two frames of images as an example.

For example, in the corresponding phase of the first frame, a first reference data voltage Vref1 is applied to the gate electrode of the first transistor T1 to allow the first transistor T1 to generate a first charging current I1 under control of the first reference data voltage Vref1, and after the parasitic capacitor Cs on the sensing signal line SEN being charged for the first time M1 through the first charging current I1, the first sensing voltage Vsen1 on the sensing signal line SEN is obtained; and in the corresponding phase of the second frame, a second reference data voltage Vref2 is applied to the gate electrode of the first transistor T1 to allow the first transistor T1 to generate a second charging current I2 under control of the second reference data voltage Vref2, and after the parasitic capacitor Cs on the sensing signal line SEN being charged for the second time M2 through the second charging current I2, the second sensing voltage Vsen2 on the sensing signal line SEN is obtained.

For example, according to the current formula of the first transistor T1 in a saturated state, it may be obtained that:

$$I1=K(V\text{ref}1-Vth)^2 \tag{1}$$

$$I2=K(V\text{ref}2-Vth)^2 \tag{2}$$

For example, the first sensing voltage Vsen1 and the second sensing voltage Vsen2 may satisfy the following relationship:

$$I1\cdot M1=V\text{sen}1\cdot Cs \tag{3}$$

$$I2\cdot M2=V\text{sen}2\cdot Cs \tag{4}$$

Therefore, the value of the threshold voltage Vth and the value of the process constant K of the first transistor T1 may be derived from the above relational expressions (1) to (4) as follows:

$$Vth = \frac{Vref2 \cdot \sqrt{\frac{Vsen1 \cdot M2}{Vsen2 \cdot M1}} - Vref1}{\sqrt{\frac{Vsen1 \cdot M2}{Vsen2 \cdot M1}} - 1},$$

$$K = \frac{Cs \cdot \left(\sqrt{\frac{Vsen2}{M2}} - \sqrt{\frac{Vsen1}{M1}}\right)^2}{(Vref2 - Vref1)^2}.$$

For example, according to different actual needs, the first time M1 and the second time M2 may be the same or different; and the first reference data voltage Vref1 and the second reference data voltage Vref2 may be the same or different. The embodiments of the present disclosure are not limited in this aspect.

It should be noted that the above compensation value calculating circuit and compensation calculating circuit may be composed of circuit elements such as transistors, resistors, capacitors, and amplifiers, or may also be implemented by signal processors such as the field programmable gate array (FPGA), digital signal process (DSP), micro-control unit (MCU), etc. Alternatively, the above compensation value calculating circuit and compensation calculating circuit may include a processor and a memory, and the processor executes the software program stored in the memory to implement the corresponding calculation and compensation function. The embodiments of the present disclosure are not limited in this aspect.

In the data writing phase 4, the first scanning line SL1 provides a high level first scanning signal S1, and the second scanning line SL2 provides a low level second scanning signal S2.

For example, the fourth transistor T4 is turned on in response to the high level first scanning signal S1, and the data line DL writes the compensated display data voltage Vdat calculated in the compensation calculating phase 3 to the gate electrode of the first transistor T1 through the fourth transistor T4. The compensated display data voltage Vdat is stored in the storage capacitor C1, so as to be used to control the first transistor T1 to generate the corresponding driving current in the subsequent display phase 5 to drive the light-emitting element EL to emit light.

For example, the second transistor T2 is turned on in response to the high level first scanning signal S1, so as to electrically connect the second voltage terminal VSS to the second electrode of the first transistor T1 and apply the second voltage provided by the second voltage terminal VSS to the second electrode of the first transistor T1 and the anode of the light-emitting element EL, thereby preventing the current from flowing through the light-emitting element EL in the data writing phase 4 and thus further preventing the light-emitting element EL from emitting light in the data writing phase 4.

It should be noted that, in the data writing phase 4, in the case where a plurality of pixel circuits share one sensing signal line SEN, the second scanning line SL2 may provide the low level second scanning signal S2 as illustrated in FIG. 4, so that the third transistor T3 is turned off in response to the low level second scanning signal S2, thereby avoiding affecting the sensing signal on the sensing signal line SEN. In some other embodiments, for example, in the case where the respective pixel circuits are electrically connected to different sensing signal lines SEN, the second scanning line SL2 may also provide a high level second scanning signal S2 to allow the third transistor T3 to be turned on, and the embodiments of the present disclosure are not limited in this aspect.

In the display phase 5, the first scanning line SL1 provides a low level first scanning signal S1, and the second scanning line SL2 provides a low level second scanning signal S2. The second transistor T2 and the fourth transistor T4 are turned off in response to the low level first scanning signal S1, and the third transistor T3 is turned off in response to the low level second scanning signal S2. The first transistor T1 generates the driving current under control of the compensated display data voltage Vdat stored in the storage capacitor C1 to drive the light-emitting element EL to emit light, so that the pixel circuit 20 may achieve the compensation effect of real-time compensation, the brightness uniformity of the display image may be significantly improved, and the display quality of the image may be improved.

For example, the pixel circuit 20 of each of the embodiments of the present disclosure may be arranged in the display device in an array manner. For example, the pixel circuits 20 included in the plurality of sub-pixels in the same row are connected to the same first scanning line SL1 and the same second scanning line SL2, and the pixel circuits 20 included in the plurality of sub-pixels in different rows are connected to different first scanning lines SL1 and different second scanning lines SL2. For example, the pixel circuits 20 included in the plurality of sub-pixels in the same column are connected to the same data line DL and the same sensing signal line SEN, and the pixel circuits 20 included in the plurality of sub-pixels in different columns are connected to different data lines DL and different sensing signal lines SEN.

Figure 5:
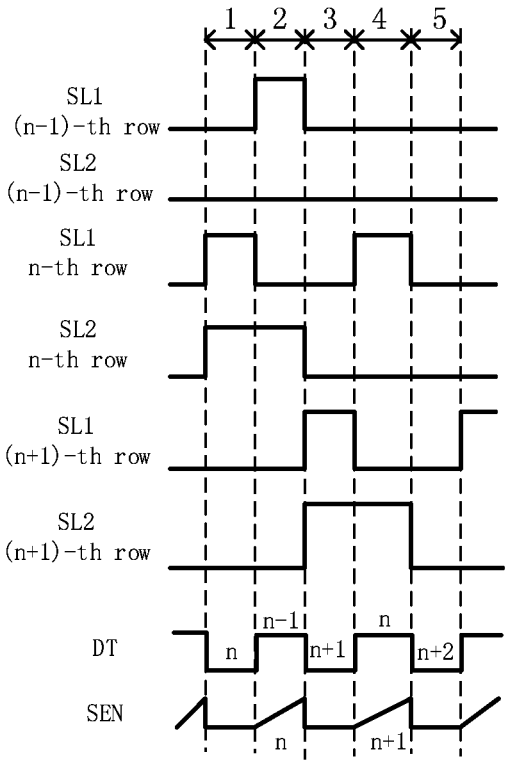

FIG. 5 is another signal timing diagram corresponding to the case where a plurality of pixel circuits 20 illustrated in FIG. 3 are connected to the same data line DL and the same sensing signal line SEN.

For example, as illustrated in FIG. 5, in the case where a plurality of pixel circuits 20 located in the same column are connected to the same data line DL, the same data line DL may provide corresponding different data voltages, such as different display data voltages Vdat and different reference data voltages Vref corresponding to the pixel circuits 20 in the respective rows, to the plurality of pixel circuits 20. It should be noted that the reference data voltages Vref corresponding to the pixel circuits 20 in the respective rows may be the same or different, and the embodiments of the present disclosure are not limited in this aspect.

For example, as illustrated in FIG. 5, in the case where the plurality of pixel circuits 20 located in the same column are connected to the same sensing signal line SEN, different sensing signals corresponding to the plurality of pixel circuits 20 may be obtained through the sensing signal line SEN, respectively, so that the characteristic parameter of the first transistor T1 in the pixel circuit 20 in each row may be calculated. It should be noted that in the case where the plurality of pixel circuits 20 are connected to the same sensing signal line SEN, the corresponding sensing signal on the sensing signal line SEN needs to be acquired at the end of the charging phase 2 corresponding to each pixel circuit 20, so as to avoid the influence of the reset voltage written, for example, in the reset phase 1 corresponding to the pixel circuit 20 in the next row on the sensing signal on the sensing signal line SEN. In addition, the second scanning line SL2 needs to provide the low level second scanning signal S2 in the data writing phase 4 corresponding to the pixel circuit 20 in the current row, so that the third transistor T3 is turned off in response to the low level second scanning signal S2, thereby avoiding affecting the charging of the sensing signal line SEN by the pixel circuits 20 in other rows.

For example, as illustrated in FIG. 5, in the reset phase 1 corresponding to the pixel circuit 20 in the n-th row, the pixel circuit 20 in the (n−1)-th row is in the compensation calculating phase 3, the data line DL provides the reference data voltage Vref corresponding to the pixel circuit 20 in the n-th row, and the voltage on the sensing signal line SEN is the reset voltage.

In the charging phase 2 corresponding to the pixel circuit 20 in the n-th row, the pixel circuit 20 in the (n−1)-th row is in the data writing phase 4, the data line DL provides the compensated display data voltage Vdat corresponding to the pixel circuit 20 in the (n−1)-th row, the pixel circuit 20 in the n-th row charges the sensing signal line SEN, and the voltage on the sensing signal line SEN at the end of this phase is the sensing signal corresponding to the pixel circuit 20 in the n-th row.

In the compensation calculating phase 3 corresponding to the pixel circuit 20 in the n-th row, the pixel circuit 20 in the (n−1)-th row is in the display phase 5, the pixel circuit 20 in the (n+1)-th row is in the reset phase 1, the data line DL provides the reference data voltage Vref corresponding to the pixel circuit 20 in the (n+1)-th row, and the voltage on the sensing signal line SEN is the reset voltage.

In the data writing phase 4 corresponding to the pixel circuit 20 in the n-th row, the pixel circuit 20 in the (n+1)-th row is in the charging phase 2, the data line DL provides the compensated display data voltage Vdat corresponding to the pixel circuit 20 in the n-th row, the pixel circuit 20 in the (n+1)-th row charges the sensing signal line SEN, and the voltage on the sensing signal line SEN at the end of this phase is the sensing signal corresponding to the pixel circuit 20 in the (n+1)-th row.

In the display phase 5 corresponding to the pixel circuit 20 in the n-th row, the pixel circuit 20 in the (n+1)-th row is in the compensation calculating phase 3, the data line DL provides the reference data voltage Vref corresponding to the pixel circuit 20 in the (n+2)-th row, and the voltage on the sensing signal line SEN is the reset voltage.

Therefore, based on the pixel circuit 20 provided by the embodiments of the present disclosure, the compensation method of the pixel circuit may be simplified, and in the display of one frame of image, the characteristic parameters of the drive transistors (i.e., the first transistors T1) in the pixel circuits in a plurality of rows (such as two or three rows) may be detected and compensated, thereby reducing the time required to compensate for the display data voltage applied to the pixel circuit and achieving the compensation effect of real-time compensation.

At least one embodiment of the present disclosure further provides a data driver, including: a compensation value calculating circuit and a compensation calculating circuit. The compensation value calculating circuit is configured to calculate a characteristic parameter of the drive circuit of the sub-pixel according to acquired compensation detecting data of the sub-pixel; and the compensation calculating circuit is configured to calculate compensated display data, which is to be applied to the sub-pixel, based on display data provided to the sub-pixel and the characteristic parameter calculated by the compensation value calculating circuit.

The data driver is, for example, a data driving integrated circuit, and is used to receive such as the data signal of the digital image (e.g., the video) and the control signal provided by, for example, a timing controller, convert the digital signal into the corresponding analog grayscale voltage signal through digital-to-analog conversion, and input the corresponding analog grayscale voltage signal to the sub-pixel of the display device, so as to drive the light-emitting element in the sub-pixel to implement the "grayscale" display of the sub-pixel.

The data driver is described below by taking the case that the sub-pixel adopts the pixel circuit (for example, the pixel circuit 10 or the pixel circuit 20) provided by the embodiments of the present disclosure as an example.

Figure 6:
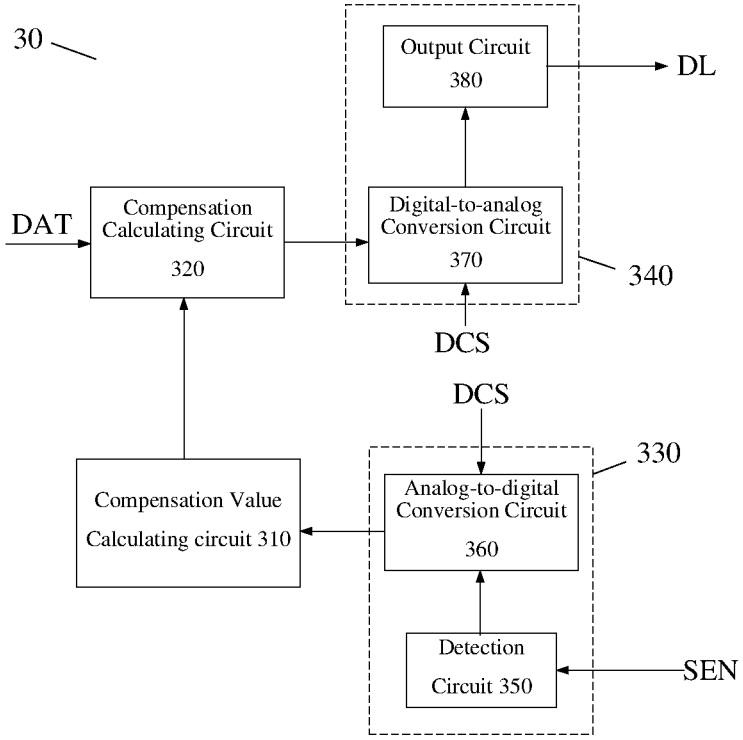
FIG. 6 is a schematic block diagram of a data driver provided by some embodiments of the present disclosure.

FIG. 6 is a schematic block diagram of a data driver 30 provided by some embodiments of the present disclosure. For example, as illustrated in FIG. 6, the data driver 30 includes a compensation value calculating circuit 310, a compensation calculating circuit 320, a detection control circuit 330, and an output control circuit 340. For example, the data driver 30 includes a plurality of groups, each group is composed of the above-mentioned structures, each group includes the compensation value calculating circuit 310, the compensation calculating circuit 320, the detection control circuit 330, and the output control circuit 340, and each group corresponds to, for example, a column of sub-pixels of the display device.

The detection control circuit 330 includes a detection circuit 350 and an analog-to-digital conversion circuit 360.

For example, the detection circuit 350 is electrically connected to the sensing signal line SEN corresponding to a column of sub-pixels, and is configured to acquire the sensing signal on the sensing signal line SEN, for example, at the end of the charging phase 2. For example, the driving circuit 100 generates the charging current under control of the written reference data voltage Vref, and after the sensing signal line SEN being charged by the charging current for the first time M1, the detection circuit 350 is electrically connected to the sensing signal line SEN to detect the magnitude of the voltage on the sensing signal line SEN. The voltage is the sensing signal corresponding to the pixel circuit 20.

For example, the detection circuit 350 may be implemented in various suitable forms. For example, the detection circuit 350 may be an interface circuit of the data driver 30, and may include an amplification sub-circuit, and the amplification sub-circuit amplifies the sensing signal acquired from the sensing signal line SEN, and provides the amplified voltage signal to the analog-to-digital conversion circuit 360.

For example, the analog-to-digital conversion circuit 360 is configured to, under control of a data control signal DCS provided by a timing controller (not illustrated), convert the sensing signal (i.e., the amplified voltage signal) on the sensing signal line SEN acquired by the detection circuit 350 into the sensing data (i.e., a digital signal), and provide the sensing data to the compensation value calculating circuit 310 as the compensation detecting data of the sub-pixel.

For example, the analog-to-digital conversion circuit 360 may be implemented in various suitable forms, and may include, for example, an analog-to-digital conversion (ADC) circuit, and the analog-to-digital conversion circuit converts the voltage signal provided by the detection circuit 350 into the digital signal, which may be used by the compensation value calculating circuit 310 for subsequent analysis, calculation, or the like.

The compensation value calculating circuit 310 is configured to calculate the characteristic parameter of the drive circuit 100 in the sub-pixel according to the acquired compensation detecting data of the sub-pixel, for example, the characteristic parameter includes the threshold voltage and the process constant of the first transistor T1 in the drive circuit 100, and the calculated characteristic parameter is provided to the compensation calculating circuit 320. It should be noted that the embodiments of the present disclosure do not limit the specific calculation method of the characteristic parameter.

For example, the compensation value calculating circuit 310 may be implemented in various suitable forms, such as transistors, resistors, capacitors, and amplifiers, or may be implemented by signal processors such as the field programmable gate array (FPGA), digital signal process (DSP), micro-control unit (MCU), etc. Alternatively, the compensation value calculating circuit may include a processor and a memory, and the processor executes the software program stored in the memory to implement the function of calculating the characteristic parameter of the drive circuit 100.

The compensation calculating circuit 320 is configured to calculate the compensated display data, which is to be applied to the sub-pixel, based on the display data DAT applied to the sub-pixel and the characteristic parameter calculated by the compensation value calculating circuit 310, and provide the compensated display data, which is obtained through calculation, to the output control circuit 340. For example, based on the characteristic parameter calculated by the compensation value calculating circuit 310, the compensation calculating circuit 320 compensates for the corresponding display data DAT applied to the sub-pixel, so that after the display data DAT applied to each sub-pixel in the display device including the data driver 30 is compensated, the brightness uniformity of the display device is significantly improved, thereby improving the display quality of the image. It should be noted that the embodiments of the present disclosure do not limit the specific calculation and compensation method of the display data DAT.

For example, the compensation calculating circuit 320 may be implemented in various suitable forms. For example, the compensation calculating circuit 320 may include a display data latch circuit, or the like. The display data latch circuit includes two groups of registers, one group of registers may be used to receive and store the display data provided by the display data register (e.g., Data Latch), and the other group of registers may be used to store the compensated display data, which is calculated, and provide the compensated display data to the output control circuit 340. For example, the compensation calculating circuit 320 may further include a calculation circuit, the calculation circuit may read the input display data and the characteristic parameter obtained by the compensation value calculating circuit 310, so as to obtain the compensated display data. For another example, the compensation calculating circuit 320 may further include a processor and a memory, and the processor executes the software program stored in the memory to implement the function of calculating the compensated display data.

For example, as needed, the data driver 30 may further include a GAMMA correction and grayscale voltage generation circuit (e.g., GAMMA Block). The GAMMA correction and grayscale voltage generation circuit is used to calculate the display data corresponding to the required grayscale after compensation. For another example, the data driver 30 may further include a data buffer (e.g., Line Buffer), and the data buffer is used to buffer the data signal corresponding to one row, which is transmitted on the data bus, of the image to be displayed, and simultaneously provide the data signal to the subsequent processing circuit for each column of sub-pixels, for example, provide the data signal to the compensation calculating circuit 320 illustrated in FIG. 6. For another example, the data driver 30 may further include a level shifter which is used to increase the voltage amplitude of the digital signal, so as to facilitate subsequent digital-to-analog conversion. For example, the level shifter is provided between the compensation calculating circuit 320 and the digital-to-analog conversion circuit 370 (to be described below). The embodiments of the present disclosure do not limit the components other than the structures illustrated in FIG. 6.

For example, the output control circuit 340 includes a digital-to-analog conversion circuit 370 and an output circuit 380.

For example, the digital-to-analog conversion circuit 370 is configured to convert the compensated display data calculated by the compensation calculating circuit 320 into an analog voltage signal under control of the data control signal DCS provided by the timing controller (not illustrated), and provide the analog voltage signal to the output circuit 380. For example, the digital-to-analog conversion circuit 370 may also be configured to receive the reference data, convert the reference data into an analog voltage signal under control of the data control signal DCS provided by the timing controller, and provide the analog voltage signal to the output circuit 380.

For example, the digital-to-analog conversion circuit 370 may be implemented in various suitable forms, and for example, may include a digital-to-analog conversion (DAC) circuit, such as a grayscale voltage selection circuit, and the grayscale voltage selection circuit converts the display data provided by the compensation calculating circuit 320 into a high-voltage analog signal, and transmits the high-voltage analog signal to the data line DL through the output circuit 380.

The output circuit 380 is electrically connected to the data line DL corresponding to, for example, one column of sub-pixels, and is configured to apply the compensated display data voltage Vdat to the drive circuit 100 of the sub-pixel through the data line DL, so that the drive circuit 100 may generate the corresponding driving current under control of the compensated display data voltage Vdat to drive the light-emitting element 400 in the sub-pixel to emit light.

For another example, the output circuit 380 may be further configured to apply the reference data voltage Vref to the drive circuit 100 of the sub-pixel, so that the drive circuit 100 may generate the corresponding charging current under control of the written reference data voltage Vref to charge the sensing signal line SEN.

For example, the output circuit 380 processes, such as performs operational amplification on, the analog voltage signal provided by the digital-to-analog conversion circuit 370 to obtain the data voltage, that is, the display data voltage Vdat and the reference data voltage Vref, and provides the corresponding data voltage to the sub-pixel through the data line DL.

For example, the output circuit 380 may be implemented in various suitable forms. For example, the output circuit 380 may include an output buffer. The output buffer uses, for example, a unit-gain operational amplification structure (such as an operational amplifier) to process the analog voltage signal provided by the digital-to-analog conversion circuit 370, and is electrically connected to the drive circuit 100 of the sub-pixel through the data line DL, so as to apply the corresponding data voltage to the sub-pixel.

Therefore, as illustrated in FIG. 6, the data driver 30 may integrate the detection function and the calculation function for the compensation data into the corresponding units and circuits inside the data driver 30, thereby simplifying the circuit design around the timing controller in the display device including the data driver 30, significantly improving the integration of the display device, and effectively reducing the manufacturing cost of the display device.

At least one embodiment of the present disclosure further provides a display device. The display device includes a plurality of sub-pixels, and each sub-pixel includes the pixel circuit described in any one of the embodiments of the present disclosure.

For example, the display device further includes a data driver, and the data driver may be the data driver described in any one of the embodiments of the present disclosure, for example, the data driver 30 illustrated in FIG. 6. For example, the data driver may be electrically connected to the pixel circuit of the sub-pixel through the data line and the sensing signal line.

For example, in the display device provided by at least one embodiment of the present disclosure, the plurality of sub-pixels are arranged in an array, and a plurality of pixel circuits in the same column are connected to the same data line and the same sensing signal line. In the same column, in the case where the pixel circuit in the n-th row charges the sensing signal line (that is, the second terminal of the drive circuit of the sub-pixel in the n-th row is connected to the sensing signal line), the data driver writes the corresponding display data voltage to the control terminal of the drive circuit of the pixel circuit in the (n−1)-th row through the data line, and n is an integer greater than 1.

Figure 7:
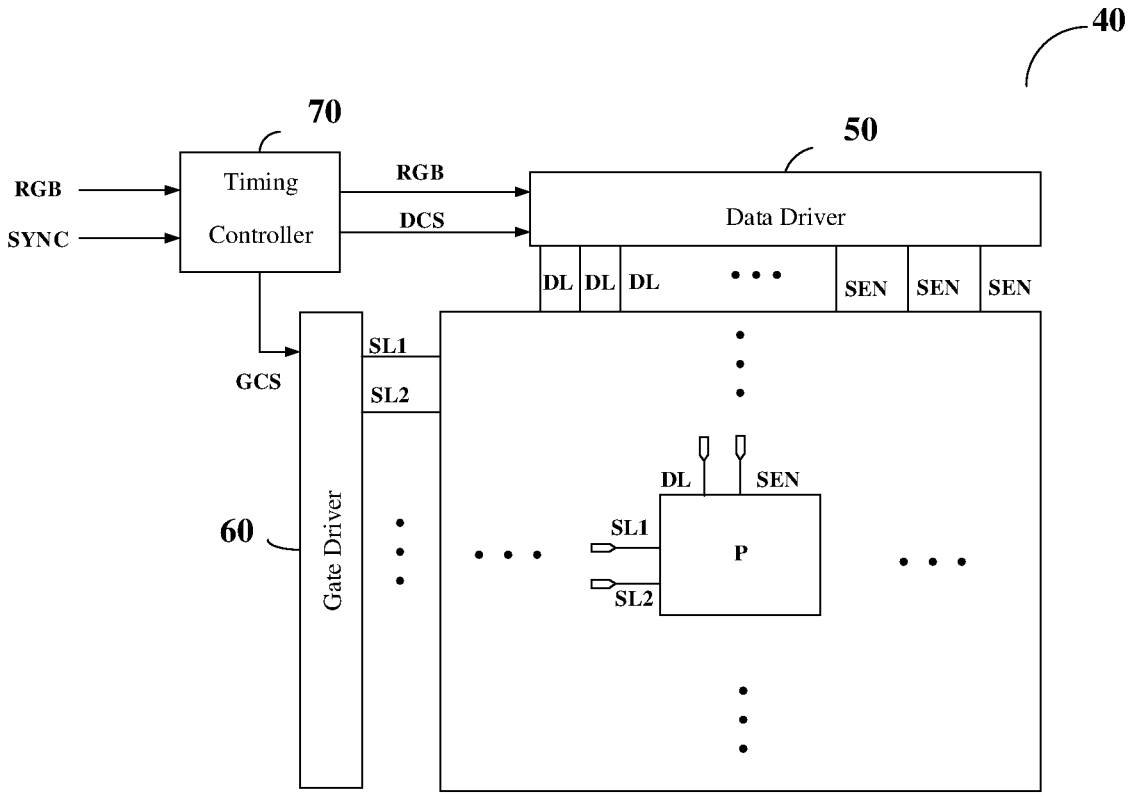
FIG. 7 is a schematic block diagram of a display device provided by some embodiments of the present disclosure.

FIG. 7 is a schematic block diagram of a display device 40 provided by some embodiments of the present disclosure. As illustrated in FIG. 7, the display device 40 includes a data driver 50, and the data driver 50 may be the data driver described in any one of the embodiments of the present disclosure, for example, the data driver 30 illustrated in FIG. 6. For example, the display device 40 may be any product or component with a display function, such as a liquid crystal panel, a liquid crystal TV, an OLED panel, an OLED TV, a display, an electronic paper display device, a mobile phone, a tablet computer, a notebook computer, a digital photo frame, a navigator, etc., and the embodiments of the present disclosure are not limited in this aspect. The technical effects of the display device 40 may be with reference to the corresponding descriptions of the pixel circuit 10 or 20 and the data driver 30 in the above-mentioned embodiments, and details are not described herein again.

For example, in one example, the display device 40 includes a data driver 50, a gate driver 60, a timing controller 70, and a plurality of sub-pixels P arranged in an array, and each sub-pixel P includes the pixel circuit provided by the embodiments of the present disclosure.

For example, the data driver 50 is electrically connected to the pixel circuits in the respective sub-pixels P through a plurality of data lines DL and a plurality of sensing signal lines SEN. For example, the data driver 50 converts the digital image data RGB input from the timing controller 70 into the data signal (for example, display data DAT and reference data) according to the data control signal DCS provided by the timing controller 70. For example, the data driver 50 converts the data signal into an analog voltage signal according to the data control signal DCS provided by the timing controller 70, and provides corresponding data voltages (e.g., the display data voltage Vdat and the reference data voltage Vref) to the pixel circuit in each sub-pixel P through the data line DL after the analog voltage signal being processed, such as being performed operational amplification. For example, the data driver 50 converts the sensing signal acquired from the sensing signal line SEN into a digital signal according to the data control signal DCS provided by the timing controller 70, and the digital signal is used to calculate and compensate for the characteristic parameter of the drive circuit in each sub-pixel P. For example, the data driver 50 may be implemented as a semiconductor chip.

For example, the gate driver 60 is electrically connected to the pixel circuits in the responsive sub-pixels P through a plurality of first scanning lines SL1 and a plurality of second scanning lines SL2 to provide the first scanning signals S1 and the second scanning signals S2 to the pixel circuits, respectively. For example, the gate driver 60 provides gate signals, that is, the first scanning signal S1 and the second scanning signal S2, according to a plurality of gate control signals GCS (i.e., scanning control signals) provided by the timing controller 70. For example, the gate driver 60 may be implemented as a semiconductor chip, or may be integrated in the display device 40 to constitute a GOA circuit.

For example, the timing controller 70 is used to process the image data RGB input from the outside of the display device 40, provide the processed image data RGB to the data driver 50, and provide the data control signal DCS and the gate control signal GCS to the data driver 50 and the gate driver 60, respectively, so as to control the data driver 50 and the gate driver 60.

For example, the timing controller 70 processes the image data RGB input from the outside of the display device 40 to match the size and resolution of the display device 40, and then provides the processed image data RGB to the data driver 50. The timing controller 70 generates the gate control signal GCS and the data control signal DCS by using a synchronization signal SYNC (for example, a dot clock DCLK, a data enable signal DE, a horizontal synchronization signal Hsync, and a vertical synchronization signal Vsync) input from the outside of the display device 40. The timing controller 70 provides the generated data control signal DCS and the generated gate control signal GCS to the data driver 50 and the gate driver 60, respectively, so as to control the data driver 50 and the gate driver 60.

The display device 40 may further include other components, such as a signal decoding circuit, and the like. These components may be, for example, existing conventional components, and details are not described herein again.

At least one embodiment of the present disclosure further provides a driving method of the pixel circuit according to any one of the embodiments of the present disclosure, and for example, the driving method may be used to drive the pixel circuit 10 or the pixel circuit 20 according to any one of the embodiments of the present disclosure.

For example, in one example, the driving method of the pixel circuit 10 or the pixel circuit 20 includes the following operations.

In a reset phase (that is, the reset phase 1 illustrated in FIG. 4), the driving method includes: writing a reference data voltage to the control terminal 130 of the drive circuit 100 and controlling the reset circuit 200 to be turned on, so as to write a reset voltage to the second terminal 120 of the drive circuit 100 through the reset circuit 200 to reset the second terminal 120 of the drive circuit 100.

In a charging phase (that is, the charging phase 2 illustrated in FIG. 4), the driving method includes: controlling the reset circuit 200 to be turned off, controlling the sensing circuit 300 to be turned on, applying a current generated by the drive circuit 100 to the sensing signal line SEN under control of the reference data voltage, that is, charging the sensing signal line SEN through the drive circuit 100, and obtaining a sensing signal on the sensing signal line SEN after the sensing signal line SEN being charged for the first time.

In a compensation calculating phase (that is, the compensation calculating phase 3 illustrated in FIG. 4), the driving method includes: obtaining a compensated display data voltage according to the sensing signal. For example, a characteristic parameter of the drive circuit 100 is calculated according to the sensing signal, and the display data voltage applied to the drive circuit 100 is compensated based on the characteristic parameter, so as to obtain the compensated display data voltage.

In a data writing phase (that is, the data writing phase 4 illustrated in FIG. 4), the driving method includes: writing the compensated display data voltage to the control terminal 130 of the drive circuit 100.

For example, the driving method may further include: in a display phase (that is, the display phase 5 illustrated in FIG. 4), driving the light-emitting element 400 to emit light through the drive circuit 100 under control of the compensated display data voltage.

For example, the driving method may further include: in the data writing phase (i.e., the data writing phase 4 illustrated in FIG. 4), controlling the reset circuit 200 to be turned on to reset the second terminal 120 of the drive circuit 100 through the reset circuit 200. For example, in the case where the pixel circuit described in any one of the embodiments of the present disclosure includes a data writing circuit (for example, the pixel circuit 20), the driving method further includes the following steps.

In the reset phase (that is, the reset phase 1 illustrated in FIG. 4), the driving method further includes: controlling the data writing circuit 500 to be turned on to write the reference data voltage to the control terminal 130 of the drive circuit 100 to initialize the drive circuit 100.

In the data writing phase (that is, the data writing phase 4 illustrated in FIG. 4), the driving method further includes: controlling the data writing circuit 500 to be turned on to write the compensated display data voltage to the control terminal 130 of the drive circuit 100.

At least one embodiment of the present disclosure further provides a driving method of a data driver according to any one of the embodiments of the present disclosure, and the driving method includes: in a period of one frame of display image, obtaining the compensation detecting data of the sub-pixel; calculating the characteristic parameter of the drive circuit of the sub-pixel according to the compensation detecting data; and calculating the compensated display data according to the characteristic parameter and the display data provided to the sub-pixel.

For example, the driving method of the data driver provided by at least one embodiment of the present disclosure further includes: acquiring the sensing signal on the sensing signal line electrically connected to the drive circuit of the sub-pixel, and converting the sensing signal into the compensation detecting data.

For example, the driving method of the data driver provided by at least one embodiment of the present disclosure further includes: converting the compensated display data into a display data voltage, and applying the display data voltage to the drive circuit of the sub-pixel.

For example, the driving method of the data driver provided by at least one embodiment of the present disclosure further includes: applying a reference data voltage to the drive circuit of the sub-pixel, and initializing the drive circuit of the sub-pixel.

At least one embodiment of the present disclosure further provides a driving method of the display device according to any one of the embodiments of the present disclosure, and for example, the driving method may be used to drive the display device 40 described in some embodiments of the present disclosure.

For example, the plurality of sub-pixels P of the display device 40 are arranged in an array, and the driving method includes: writing a corresponding display data voltage to a sub-pixel in an (n−1)-th row, and simultaneously acquiring a sensing signal corresponding to a sub-pixel in an n-th row, n being an integer greater than 1.

For example, in a period of one frame of display image, the driving method includes the following operations.

The driving method includes: writing a corresponding reference data voltage to a control terminal of a drive circuit of the sub-pixel P in the n-th row, and resetting a second terminal of the drive circuit of the sub-pixel P in the n-th row.

The driving method includes: writing the corresponding display data voltage to a control terminal of a drive circuit of the sub-pixel P in the (n−1)-th row, resetting a second terminal of the drive circuit of the sub-pixel P in the (n−1)-th row, and simultaneously acquiring a first sensing signal corresponding to the sub-pixel P in the n-th row.

The driving method includes: acquiring a corresponding display data voltage of the sub-pixel P in the n-th row according to the first sensing signal, simultaneously writing a corresponding reference data voltage to a control terminal of a drive circuit of a sub-pixel P in an (n+1)-th row, and resetting a second terminal of the drive circuit of the sub-pixel P in the (n+1)-th row.

The driving method includes: writing the corresponding display data voltage to the control terminal of the drive circuit of the sub-pixel P in the n-th row, resetting the second terminal of the drive circuit of the sub-pixel P in the n-th row, and simultaneously acquiring a second sensing signal corresponding to the sub-pixel P in the (n+1)-th row.

For example, in one example, a plurality of pixel circuits in one column of the display device 40 are connected to the same data line DL and the same sensing signal line SEN. The driving method includes the following operations in a period of one frame of display image.

The driving method includes: in one column, writing a corresponding reference data voltage to a control terminal of a drive circuit of the sub-pixel P in the n-th row through a data line DL, and resetting a second terminal of the drive circuit of the sub-pixel P in the n-th row and a sensing signal line SEN (that is, the phase 1 illustrated in FIG. 5).

The driving method includes: in one column, writing a corresponding display data voltage to a control terminal of a drive circuit of the sub-pixel P in the (n−1)-th row through the data line DL, resetting a second terminal of the drive circuit of the sub-pixel P in the (n−1)-th row, and allowing the second terminal of the drive circuit of the sub-pixel P in the n-th row to be connected to the sensing signal line SEN to apply a current generated by the drive circuit of the sub-pixel P in the n-th row to the sensing signal line SEN under control of the corresponding reference data voltage (that is, the phase 2 illustrated in FIG. 5).

The driving method includes: in one column, writing a corresponding reference data voltage to a control terminal of a drive circuit of a sub-pixel P in an (n+1)-th row through the data line DL, and resetting a second terminal of the drive circuit of the sub-pixel P in the (n+1)-th row and the sensing signal line SEN (that is, the phase 3 illustrated in FIG. 5).

The driving method includes: in one column, writing the corresponding display data voltage to the control terminal of the drive circuit of the sub-pixel P in the n-th row through the data line DL, resetting the second terminal of the drive circuit of the sub-pixel P in the n-th row, and allowing the second terminal of the drive circuit of the sub-pixel P in the (n+1)-th row to be connected to the sensing signal line SEN to apply a current generated by the drive circuit of the sub-pixel P in the (n+1)-th row to the sensing signal line SEN under control of the corresponding reference data voltage (that is, the phase 4 illustrated in FIG. 5).

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto. Any modifications or substitutions within the technical scope of the present disclosure easily obtained by those skilled in the art should be within the protection scope of the present disclosure. Therefore the protection scope of the present disclosure should be based on the protection scope of the claims.

What is claimed is:

1. A driving method of a pixel circuit, wherein the pixel circuit comprises a drive circuit, a reset circuit, and a sensing circuit; the drive circuit comprises a control terminal, a first terminal, and a second terminal, the control terminal of the drive circuit is configured to receive a data voltage, the first terminal of the drive circuit is configured to receive a first voltage, and the second terminal of the drive circuit is configured to be electrically connected to a light-emitting element; the reset circuit is electrically connected to the second terminal of the drive circuit, and is configured to reset the second terminal of the drive circuit in response to a first scanning signal; the sensing circuit is electrically connected to the second terminal of the drive circuit, and is configured to connect the second terminal of the drive circuit to a sensing signal line in response to a second scanning signal, the second scanning signal being different from the first scanning signal; and the driving method comprises:

writing a reference data voltage to the control terminal of the drive circuit and controlling the reset circuit to be turned on in a reset phase, so as to reset the second terminal of the drive circuit through the reset circuit;

controlling the reset circuit to be turned off, controlling the sensing circuit to be turned on, applying a current generated by the drive circuit to the sensing signal line under control of the reference data voltage, and obtaining a sensing signal on the sensing signal line in a charging phase;

obtaining a compensated display data voltage according to the sensing signal in a compensation calculating phase; and writing the compensated display data voltage to the control terminal of the drive circuit in a data writing phase.

2. The driving method of the pixel circuit according to claim 1, wherein obtaining the compensated display data voltage according to the sensing signal comprises:

calculating a characteristic parameter of the drive circuit according to the sensing signal, and compensating for a display data voltage applied to the drive circuit based on the characteristic parameter to obtain the compensated display data voltage.

3. The driving method of the pixel circuit according to claim 1, further comprising:

driving the light-emitting element to emit light through the drive circuit under control of the compensated display data voltage in a display phase.

4. The driving method of the pixel circuit according to claim 1, further comprising:

controlling the reset circuit to be turned on to reset the second terminal of the drive circuit through the reset circuit in the data writing phase.

5. The driving method of the pixel circuit according to claim 1, wherein in a case where the pixel circuit comprises a data writing circuit, the driving method further comprises:

controlling the data writing circuit to be turned on to write the reference data voltage to the control terminal of the drive circuit to initialize the drive circuit in the reset phase, and controlling the data writing circuit to be turned on to write the compensated display data voltage to the control terminal of the drive circuit in the data writing phase.

6. The driving method of the pixel circuit according to claim 1, wherein the pixel circuit further comprises a data writing circuit and a storage circuit, the data writing circuit is electrically connected to the control terminal of the drive circuit, and is configured to apply the data voltage to the control terminal of the drive circuit in response to the first scanning signal, a first terminal of the storage circuit is electrically connected to the control terminal of the drive circuit, and a second terminal of the storage circuit is electrically connected to the second terminal of the drive circuit.

7. The driving method of the pixel circuit according to claim 6, wherein the data writing circuit comprises a fourth transistor, and the storage circuit comprises a storage capacitor;

a gate electrode of the fourth transistor is electrically connected a first scanning line to receive the first scanning signal, a first electrode of the fourth transistor is electrically connected to a data line to receive the data voltage, and a second electrode of the fourth transistor is electrically connected to the control terminal of the drive circuit; and a first electrode of the storage capacitor serves as the first terminal of the storage circuit, and a second electrode of the storage capacitor serves as the second terminal of the storage circuit.

8. The driving method of the pixel circuit according to claim 1, wherein the pixel circuit further comprises the light-emitting element, the light-emitting element comprises a first terminal and a second terminal, the first terminal of the light-emitting element is electrically connected to the second terminal of the drive circuit, and the second terminal of the light-emitting element is configured to receive a second voltage, the second voltage being lower than the first voltage.

9. The driving method of the pixel circuit according to claim 1, wherein the drive circuit comprises a first transistor, a gate electrode of the first transistor serves as the control terminal of the drive circuit, a first electrode of the first transistor serves as the first terminal of the drive circuit, and a second electrode of the first transistor serves as the second terminal of the drive circuit.

10. The driving method of the pixel circuit according to claim 1, wherein the reset circuit comprises a second transistor, a gate electrode of the second transistor is electrically connected to a first scanning line to receive the first scanning signal, a first electrode of the second transistor is electrically connected to the second terminal of the drive circuit, and a second electrode of the second transistor is electrically connected to a reset voltage terminal to receive a reset voltage.

11. The driving method of the pixel circuit according to claim 1, wherein the sensing circuit comprises a third transistor, a gate electrode of the third transistor is electrically connected to a second scanning line to receive the second scanning signal, a first electrode of the third transistor is electrically connected to the second terminal of the drive circuit, and a second electrode of the third transistor is electrically connected to the sensing signal line.

12. A driving method of a display device, wherein the display device comprises a plurality of sub-pixels, and each of the sub-pixels comprises a pixel circuit; the pixel circuit comprises a drive circuit, a reset circuit, and a sensing circuit; the drive circuit comprises a control terminal, a first terminal, and a second terminal, the control terminal of the drive circuit is configured to receive a data voltage, the first terminal of the drive circuit is configured to receive a first voltage, and the second terminal of the drive circuit is configured to be electrically connected to a light-emitting element; the reset circuit is electrically connected to the second terminal of the drive circuit, and is configured to reset the second terminal of the drive circuit in response to a first scanning signal; the sensing circuit is electrically connected to the second terminal of the drive circuit, and is configured to connect the second terminal of the drive circuit to a sensing signal line in response to a second scanning signal, the second scanning signal being different from the first scanning signal; the plurality of sub-pixels are arranged in an array;

the driving method comprises:

writing a corresponding display data voltage to a sub-pixel in an (n−1)-th row, and simultaneously acquiring a sensing signal corresponding to a sub-pixel in an n-th row, wherein n is an integer greater than 1; and in a period of one frame of display image, the driving method comprises:

writing a corresponding reference data voltage to a control terminal of a drive circuit of the sub-pixel in the n-th row, and resetting a second terminal of the drive circuit of the sub-pixel in the n-th row;

writing the corresponding display data voltage to a control terminal of a drive circuit of the sub-pixel in the (n−1)-th row, resetting a second terminal of the drive circuit of the sub-pixel in the (n−1)-th row, and simultaneously acquiring a first sensing signal corresponding to the sub-pixel in the n-th row;

acquiring a corresponding display data voltage of the sub-pixel in the n-th row according to the first sensing signal, simultaneously writing a corresponding reference data voltage to a control terminal of a drive circuit of a sub-pixel in an (n+1)-th row, and resetting a second terminal of the drive circuit of the sub-pixel in the (n+1)-th row; and writing the corresponding display data voltage to the control terminal of the drive circuit of the sub-pixel in the n-th row, resetting the second terminal of the drive circuit of the sub-pixel in the n-th row, and simultaneously acquiring a second sensing signal corresponding to the sub-pixel in the (n+1)-th row.

13. The driving method of the display device according to claim 12, wherein a plurality of pixel circuits in one column are connected to an identical data line and an identical sensing signal line, and in a period of one frame of display image, the driving method comprises:

in one column, writing a corresponding reference data voltage to a control terminal of a drive circuit of the sub-pixel in the n-th row through a data line, and resetting a second terminal of the drive circuit of the sub-pixel in the n-th row and a sensing signal line;

in the one column, writing a corresponding display data voltage to a control terminal of a drive circuit of the sub-pixel in the (n−1)-th row through the data line, resetting a second terminal of the drive circuit of the sub-pixel in the (n−1)-th row, and allowing the second terminal of the drive circuit of the sub-pixel in the n-th row to be connected to the sensing signal line to apply a current generated by the drive circuit of the sub-pixel in the n-th row to the sensing signal line under control of the corresponding reference data voltage;

in the one column, writing a corresponding reference data voltage to a control terminal of a drive circuit of a sub-pixel in an (n+1)-th row through the data line, and resetting a second terminal of the drive circuit of the sub-pixel in the (n+1)-th row and the sensing signal line; and in the one column, writing the corresponding display data voltage to the control terminal of the drive circuit of the sub-pixel in the n-th row through the data line, resetting the second terminal of the drive circuit of the sub-pixel in the n-th row, and allowing the second terminal of the drive circuit of the sub-pixel in the (n+1)-th row to be connected to the sensing signal line to apply a current generated by the drive circuit of the sub-pixel in the (n+1)-th row to the sensing signal line under control of the corresponding reference data voltage.

14. The driving method of the display device according to claim 12, wherein the display device further comprises a data driver, the data driver comprises a compensation value calculating circuit and a compensation calculating circuit, the compensation value calculating circuit is configured to calculate a characteristic parameter of the drive circuit of the sub-pixel according to acquired compensation detecting data of the sub-pixel, and the compensation calculating circuit is configured to calculate compensated display data, which is to be applied to the sub-pixel, based on display data provided to the sub-pixel and the characteristic parameter calculated by the compensation value calculating circuit.

15. The driving method of the display device according to claim 14, wherein the data driver further comprises a detection control circuit and an output control circuit;

the detection control circuit comprises a detection circuit, and the detection circuit is configured to acquire a sensing signal on a sensing signal line electrically connected to the drive circuit of the sub-pixel;

the detection control circuit is further configured to convert the sensing signal into sensing data, and the compensation detecting data comprises the sensing data;

the output control circuit is configured to convert the compensated display data into a display data voltage; and the output control circuit comprises an output circuit, and the output circuit is configured to apply the display data voltage to the drive circuit of the sub-pixel, so as to allow the drive circuit of the sub-pixel to drive the light-emitting element of the sub-pixel to emit light under control of the display data voltage.

* * * * *